US007228651B1

(12) United States Patent
Saari

(10) Patent No.: US 7,228,651 B1
(45) Date of Patent: Jun. 12, 2007

(54) HOLDER FOR AN IDENTIFICATION CARD

(75) Inventor: Simo Saari, Espoo (FI)

(73) Assignee: Megalock Oy, Helsinki (FI)

( * ) Notice: Subject to any disclaimer, the term of this patent is extended or adjusted under 35 U.S.C. 154(b) by 21 days.

(21) Appl. No.: 10/069,170

(22) PCT Filed: Aug. 11, 2000

(86) PCT No.: PCT/FI00/00683

§ 371 (c)(1),
(2), (4) Date: May 20, 2002

(87) PCT Pub. No.: WO01/13350

PCT Pub. Date: Feb. 22, 2001

(30) Foreign Application Priority Data

Aug. 12, 1999 (FI) ..... 19991712

(51) Int. Cl.
*A44C 3/00* (2006.01)

(52) U.S. Cl. ..... 40/1.5; 40/661.04; 40/666; 24/3.12; 24/3.13; 242/371; 242/400; 224/162; 403/348

(58) Field of Classification Search ..... 40/1.5, 40/1.6, 601, 661.04, 666; 24/3.11, 3.12, 24/3.13; 242/371, 379, 379.2, 400, 378, 242/378.1, 378.2; 224/162; 403/348, 349, 403/DIG. 4

See application file for complete search history.

(56) References Cited

U.S. PATENT DOCUMENTS

| | | | | | |
|---|---|---|---|---|---|
| 3,100,608 | A * | 8/1963 | Goldfarb | 242/385.4 |
| 4,518,080 | A * | 5/1985 | Ohlson | 206/39 |
| 5,555,589 | A * | 9/1996 | Moultrie | 15/105 |
| 5,592,767 | A * | 1/1997 | Treske | 40/649 |
| 6,095,567 | A * | 8/2000 | Buell | 283/75 |
| 6,170,181 | B1 * | 1/2001 | Groner | 40/1.6 |
| 6,302,617 | B1 * | 10/2001 | Rumpp | 403/348 |
| 6,364,237 | B1 * | 4/2002 | Kagel | 242/379 |

FOREIGN PATENT DOCUMENTS

| | | | | |
|---|---|---|---|---|
| CH | 637278 | * | 7/1983 | 40/1.5 |
| EP | 264086 | * | 10/1987 | 40/1.5 |
| WO | WO-96/42852 | * | 11/1997 | 40/1.5 |

* cited by examiner

*Primary Examiner*—Gary C. Hoge
(74) *Attorney, Agent, or Firm*—Stevens, Davis, Miller & Mosher, LLP

(57) ABSTRACT

An identification card holder, on the front side of which a replaceable identification card can be placed. A spring-loaded yo-yo is fastened and positioned on the reverse side of the holder, such that the yo-yo remains partially or completely invisible as the card, along with its holder, is viewed from the front side. As the yo-yo is integrated with the holder, the result will be a small-sized, readily portable, and easy-to-handle assembly, which can be distanced from a bearer to the proximity of a code reader for an electric lock without releasing the suspension.

17 Claims, 2 Drawing Sheets

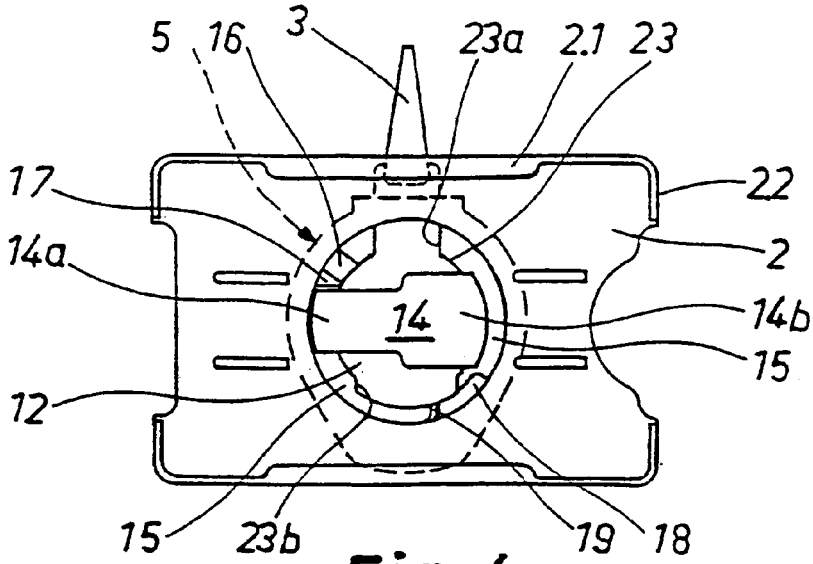
Fig. 4
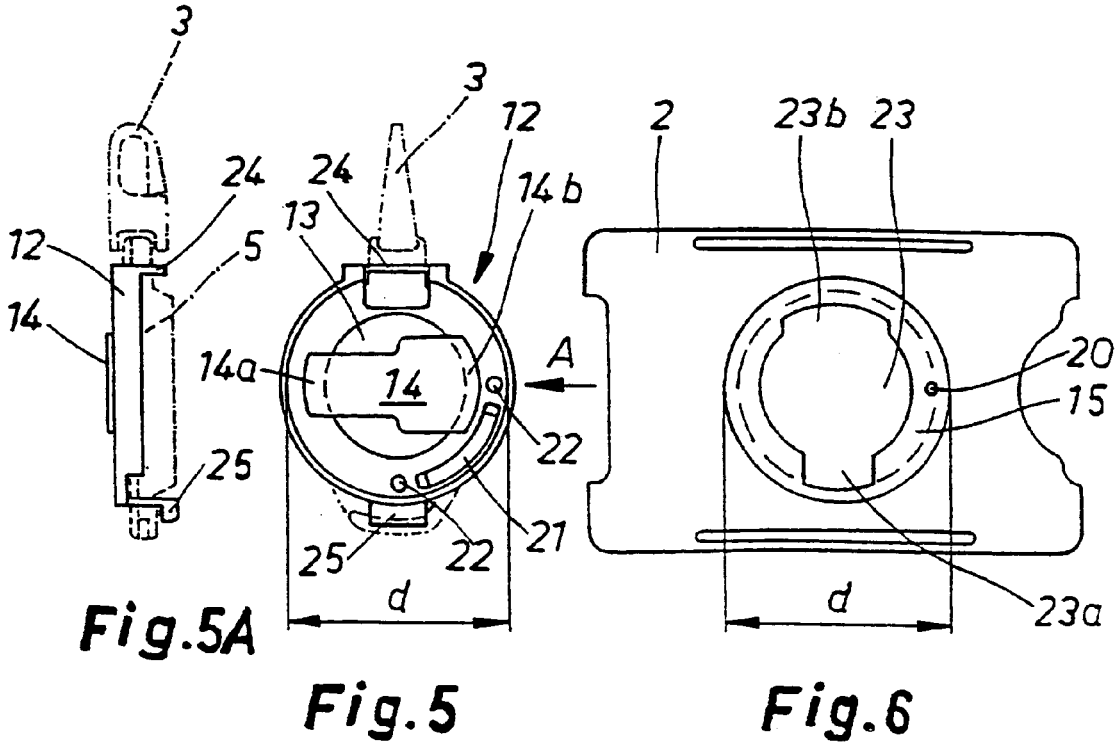
Fig.5A
Fig.5
Fig.6

HOLDER FOR AN IDENTIFICATION CARD

BACKGROUND OF THE INVENTION

The invention relates to a holder for an identification card, comprising a front side and a reverse side and provided with holding or gripping elements for the identification card for placing the replaceable identification card removably on the front side of the holder, a suspension clip for suspending the holder to a necklace or directly to a bearer's garment, as well as with a yo-yo present between the holder and the suspension clip and comprising a spring-loaded string winder and a string to whose end the suspension clip is attached.

It is prior known to use a separate yo-yo for the suspension of an identification card by way of threading a suspension clip attached to the end of the yo-yo's string through a hole in the identification card. Thus, the identification card can be distanced from its bearer or carrier for example to the proximity of a code reader for an electric lock or some other actuator without releasing the suspension.

On the other hand, it is prior known to attach identification cards to holders which can be suspended to a necklace or directly to a carrier's garment. Distancing or drawing away such identification cards from carrier to code reader is inconvenient as the carrier is often forced to assume an awkward posture to get in the immediate proximity of a code reader or to remove the card along with its holder or to remove the card from the holder (if the microchip carrying the identifier code is on the card).

The existing yo-yos and card holders may also be suspended as extensions of each other by way of suspending a card holder to a suspension clip present at the end of a yo-yo string, whereby the card, along with its card holder, can be distanced from the bearer or carrier to the proximity of a code reader without releasing the suspension. Since the yo-yo and the card holder are separate from each other and suspended as extensions of each other, the result is a bulky, awkward and poorly manageable assembly which is not pleasant to carry in suspension from a garment or around the neck. Hence, it is conventional to use a yo-yo or a card holder as alternatives to each other, the selection depending on a particular application or necessity. In ski lifts, for example, cards suspended to a yo-yo are in general use while plain card holders, without a yo-yo, have become established in office use.

SUMMARY OF THE INVENTION

It is an object of the invention to provide a holder of the above type for an identification card, which is a small-sized, readily portable, and easy-to-handle assembly which can be distanced from a carrier to the proximity of a code reader without releasing the suspension.

BRIEF DESCRIPTION OF THE DRAWINGS

The invention will now be described in more detail with reference to the accompanying drawings, in which

FIG. 4 shows a card holder according to a second embodiment of the invention in a front side or card side view, the outlines of a yo-yo 5 being visible in dashed lines behind the card holder;

FIG. 5 shows a clamp element 12 used in the embodiment of FIG. 4 for clamping the yo-yo 5 behind a card holder 2 in a variety of operating positions, such that the card holder can be in a horizontal or vertical position;

FIG. 5A shows the clamp element of FIG. 5 in a view from the direction of an arrow A in FIG. 5;

FIG. 6 shows the card holder of FIG. 4 in a reverse side view, without a clamp element shown in FIG. 5.

DETAILED DESCRIPTION OF THE INVENTION

Figures 1, 2, 3, 7:
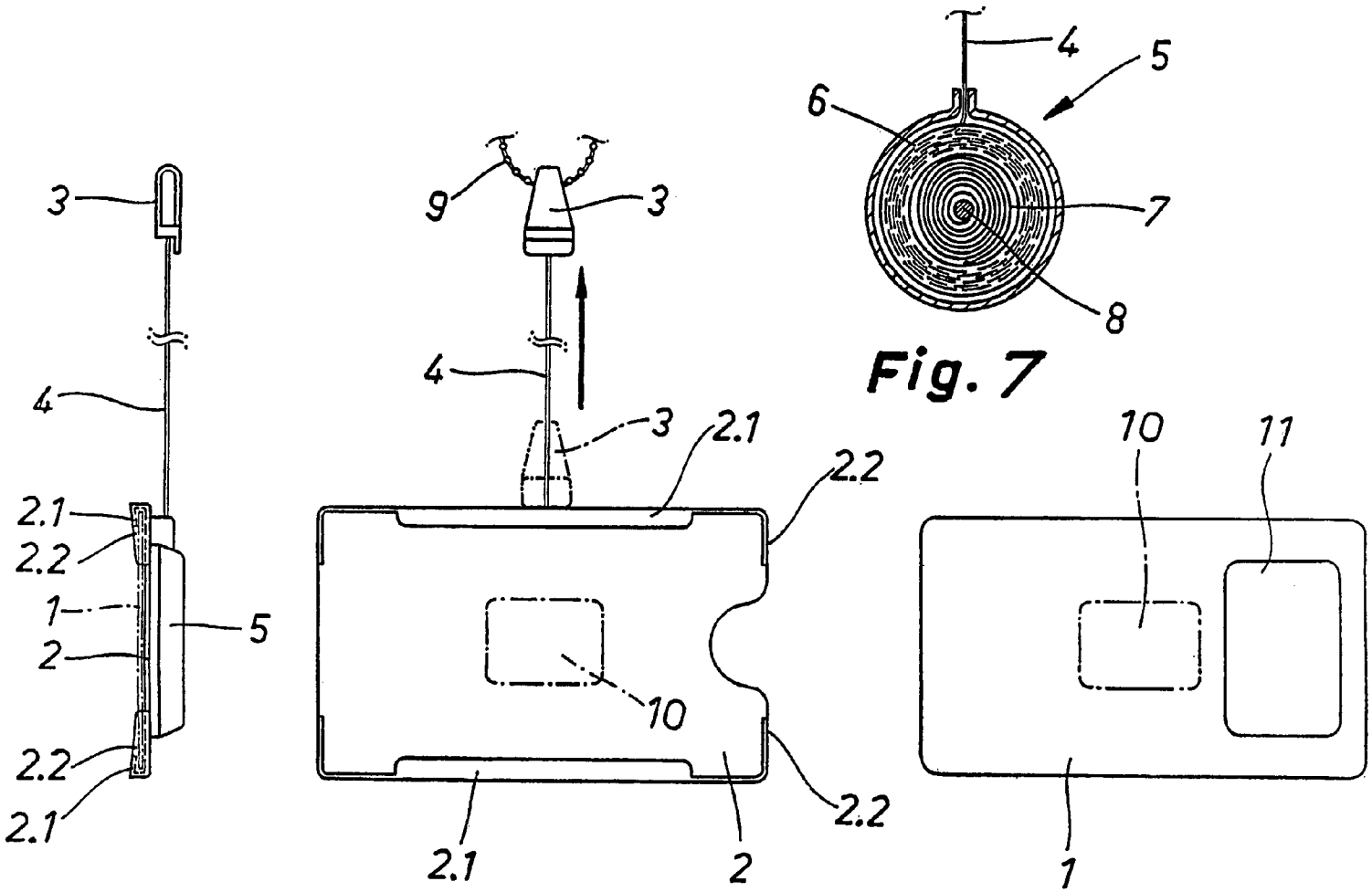
FIG. 1 shows an identification card holder of the invention in a side view.
FIG. 2 shows the holder of FIG. 1 in a front side view.
FIG. 3 shows an identification card insertable in the holder of FIG. 2.
FIG. 7 shows one example of an internal structure for the yo-yo 5 in a view of principle.

FIGS. 1 and 2 depict a holder 2 for an identification card, comprising a substantially flat base plate, the lateral sides of which are provided with lugs 2.1 and the end sides with collars 2.2 rising adjacent to the corners, which together constitute holding and gripping elements for immobilizing an identification card 1. By virtue of the design of the holding and gripping elements 2.1, 2.2 and the flexibility of the identification card 1, such an identification card can be mounted removably on the front side of the holder 2. The holder 2 has its reverse side fitted with a yo-yo 5 positioned in such a way that the yo-yo 5 is partially or preferably entirely masked by the holder 2 and/or the holder-held card 1 as the card 1, along with its holder 2, is viewed from the front side. The card 1 may be provided e.g. with a photograph 11 of the bearer, a text space (not shown) carrying the bearer's name, and a microchip 10 containing an identifier code. The microchip 10 may be optionally mounted on the card holder 2. When the microchip 10 is brought e.g. to the proximity of a code reader for an electric lock or some other actuator, a release of the lock or some other preset function shall occur, the read-out code permitting. The features associated with the microchip 10 and the code reader do not constitute an object of this invention and are generally known in connection with access control systems.

The yo-yo 5 can be mounted on the back of the card holder 2 in a removable fashion, whereby the card holder 2 and the yo-yo 5 are required to have fastening lugs, designed as counterparts for each other and enabling a firm attachment e.g. by way of a snap fit. The yo-yo 5 can be mounted as an integral part of the card holder 2 e.g. by glueing or by manufacturing a housing element for the yo-yo 5 at least partially from the same injection-moulded plastics material which is used for making the holder 2. What is essential is that the yo-yo 5 placed on the reverse side of the holder 2 is integrated as a part of the holder 2. Thus, when the card 1 is carried, no extra parts are visible as a suspension clip 3 present at the end of a yo-yo string 4 appears to join directly with the card holder 2, as shown in FIG. 2 with dash-and-dot lines. The suspension clip 3 may be accompanied by a necklace 9 or it can be fixed directly to a garment worn by the bearer, e.g. to the lip of a pocket.

FIGS. 4–6 depict more specifically a preferred structural solution of the invention, whereby the yo-yo can be attached to the back of a card holder in a removable fashion and in a variety of operating positions, such that the card is optionally either in a horizontal position or in a vertical position, as the case may be. Therefor, between the card holder 2 and the yo-yo 5 is fitted a separate clamp element 12, which is releasably securable in a locking aperture 23 of the card holder 2. The clamp element 12 is designed to accommodate the yo-yo 5 and provided with fastening lugs 24, 25 taking hold of the yo-yo 5 and having a configuration and design which depend on the design and/or protrusions of each available yo-yo, which the fastening lugs 24, 25 are adaptable to take hold of for immobilizing the yo-yo 5 relative to the clamp element 12.

The clamp element 12 includes two clamp protrusions 14*a*, 14*b* taking hold behind collars 15 of the locking aperture 23 present in the card holder 2. The locking aperture 23 has its collars 15 provide an annular recess on the card-facing side of the card holder 2. The clamp protrusions 14*a*, 14*b* are flat tongues which are set in the recess formed by the collars 15 over on the internal side of the holder 2 (see FIG. 4) after the clamp element 12 has been installed in its position on the card holder 2. In the present case, the clamp tongues 14*a*, 14*b* are obtained by placing a flat-shaped element 14 on top of a circumferentially circular boss 13 present in the clamp holder 12, the ends of said element extending out beyond the borders of the boss 13. The boss 13 is capable of rotating within the locking aperture 23. The locking aperture 23 has its collars 15 provided with two slots 23*a*, 23*b* of unequal widths for accommodating therethrough the clamp tongues 14*a*, 14*b* of respectively unequal widths.

The locking aperture collar 15 has its card-facing side provided with a wedge surface 16, the clamp tongue 14*a* being forcible thereover by turning the clamp element 12 relative to the card holder 2. Adjacent to the wedge surface 16 is a stepped border 17, the clamp tongue 14*a* colliding therewith, thus impeding a turnback of the clamp element 12. The locking aperture collar 15 has its card-facing side provided with another border surface 19, the clamp tongue 14*a* colliding therewith after turning the clamp element 12 about 90° from the position in which the same clamp tongue 14*a* has collided against the stepped border 17. The border surface 19 is preferably a steep wedge surface, which on the one hand functions as a stopper yet, on the other hand, allows the clamp tongue 14*a* to climb on top of a boss 18 present in the collar surface 15, whereby the clamp element 12 can be removed from the card holder 2 after being turned through full 360° for resetting the clamp tongue 14*a* in line with the slot 23*a*. The locking aperture collar 15 has its reverse side, upon which the clamp element 12 is set along with its yo-yo 5, provided with a retainer pin 20, and the clamp element 12 has the side thereof, which comes against the card holder 2, provided with two retainer slots 22 at a 90° angular distance from each other. Between the slots 22 is a guide groove 21 for the pin 20, having its ends provided with wedge surfaces to allow for the locking pin 20 an effortless climb from the groove 21 and a passage into the slot 22.

The identification card holder 2 and the yo-yo clamp element 12 shown in FIGS. 4–6 may both be manufactured from plastics by injection moulding. The use of a special clamp element 12 offers the benefit that the same card holder can be optionally placed in a horizontal or vertical position. In order to achieve this benefit, the structural details may depart in many ways from the details shown in FIGS. 4–6.

As for its design, the yo-yo 5 may be of any commercially available type, nor is it an object of this invention. In order to visualize the action, however, FIG. 7 illustrates one structural solution of principle, comprising a winder 6 for winding a string 4 therearound and having inside a space for a spiral spring 7, one end of which is fastened to the string winder 6 and the other end is fastened to a fixed centre axle 8. The spiral spring 7 applies such a load on the string winder 6 that the string 4 is normally completely retracted around the winder 6. When the holder 2 is distanced from a bearer, the string 4 emerges from the yo-yo 5 and enables the holder 2 and the card 1 carried thereby to be drawn away from the bearer to a distance which is typically about half a meter at maximum. When the holder 2 is released, the spring-loaded yo-yo 5 retracts, through the intermediary of the string 4, the holder 2 back alongside the suspension clip 3.

The invention claimed is:

1. A holder, comprising an identification card, a front side and a reverse side and provided with holding or gripping elements for the identification card for placing the identification card removably on the front side of the holder, a suspension clip for suspending the holder to a necklace or directly to a bearer's garment, and a yo-yo, engageable with the reverse side of the holder and comprising a spring-loaded string winder and a string to whose end the suspension clip is attached, wherein the yo-yo is fastened and positioned on the reverse side of the card holder, such that the yo-yo is partially or completely masked by the holder and/or the card as the card with the holder is viewed from the front side.

2. A holder as set forth in claim 1, wherein the card holder and the yo-yo have there between a clamp element, which is releasably insertable in a locking aperture present in the card holder and which is designed for accommodating the yo-yo and provided with fastening lugs taking hold of the yo-yo.

3. A holder as set forth in claim 2, wherein the clamp element is provided with two clamp protrusions taking a hold behind collars of the locking aperture present in the card holder.

4. A holder as set forth in claim 3, wherein the locking aperture has collars constituting an annular recess on the front side of the card holder, and that the clamp protrusions are flat clamp tongues located in said annular recess.

5. A holder as set forth in claim 4, wherein the locking aperture has the collars provided with two slots of unequal widths for accommodating therethrough the clamp tongues of respectively unequal widths.

6. A holder as set forth in claim 1, wherein the yo-yo is fastened as an integral part of the card holder.

7. A holder as set forth in claim 1, wherein a microchip containing an identifier code is attached to the holder or the identification card.

8. A holder for an identification card, comprising a front side and a reverse side and provided with holding or gripping elements for the identification card for placing the identification card removably on the front side of the holder, a suspension clip for suspending the holder to a necklace or directly to a bearer's garment, and a yo-yo that is engageable with the reverse side of the holder and comprising a spring-loaded string winder and a string to whose end the suspension clip is attached, wherein the yo-yo is fastened and positioned on the reverse side of the card holder, such that the yo-yo is partially or completely masked by the holder and/or the card as the card with the holder is viewed from the front side; wherein the card holder and the yo-yo have there between a clamp element, which is releasably insertable in a locking aperture present in the card holder and which is designed for accommodating the yo-yo and provided with fastening lugs taking hold of the yo-yo, the clamp element is provided with two clamp protrusions taking a hold behind collars of the locking aperture present in the card holder, the locking aperture has the collars constitute an annular recess on the front side of the card holder, and that the clamp protrusions are flat clamp tongues located in said annular recesses, the collars have a side facing the front of the holder which is provided with a wedge surface, and the clamp tongues include a first clamp tongue and a second clamp tongue, wherein the first clamp tongue has a smaller width than the second clamp tongue, said first clamp tongue being forcible thereover by turning the clamp element relative to the card holder, and that alongside the wedge surface is a stepped border, the clamp tongue colliding therewith, thus impeding a turn-back of the clamp element.

9. A holder as set forth in claim 8, wherein the collars have a side facing the front of the holder which is provided with another border surface, the first clamp tongue colliding therewith after turning the clamp element about 90° from the position in which the first clamp tongue has collided against the stepped border.

10. A holder as set forth in claim 9, wherein the locking aperture collar has its reverse side, upon which the clamp element is set along with the yo-yo, provided with a retainer pin, and the clamp element has the side thereof, which comes against the card holder, provided with two retainer slots at a 90° angular distance from each other.

11. A holder as set forth in claim 8, wherein the locking aperture collar has its reverse side, upon which the clamp element is set along with the yo-yo, provided with a retainer pin, and the clamp element has the side thereof, which comes against the card holder, provided with two retainer slots at a 90° angular distance from each other.

12. A holder for attaching an identification card to a garment, comprising:

a front side;

a reverse side;

gripping elements for the identification card for placing the identification card removably on the front side of the holder;

a yo-yo, attached to the reverse side of the holder and comprising a spring-loaded string winder and a string, the string comprising a first end, attached to the yo-yo and a second free end; and a suspension clip adapted to connect directly to the garment and connected to the free end of the string, wherein the yo-yo is fastened and positioned on the reverse side of the holder, such that the yo-yo is partially or completely masked by the holder and/or the card as the card with the holder is viewed from the front side.

13. A holder as set forth in claim 12, wherein the card holder and the yo-yo have there between a clamp element, which is releasably insertable in a locking aperture present in the card holder and which is designed for accommodating the yo-yo and provided with fastening lugs taking hold of the yo-yo.

14. A holder as set forth in claim 13, wherein the clamp element is provided with two clamp protrusions taking a hold behind collars of the locking aperture present in the card holder.

15. A holder as set forth in claim 14, wherein the locking aperture has collars constituting an annular recess on the front side of the card holder, and that the clamp protrusions are flat clamp tongues located in said annular recess.

16. A holder as set forth in claim 15, wherein the locking aperture has the collars provided with two slots of unequal widths for accommodating therethrough the clamp tongues of respectively unequal widths.

17. A holder as set forth in claim 12, wherein a microchip containing an identifier code is attached to the holder or the identification card.

* * * * *